US008062820B2

(12) United States Patent
Floess et al.

(10) Patent No.: US 8,062,820 B2
(45) Date of Patent: Nov. 22, 2011

(54) TONER COMPOSITION AND METHOD OF PREPARING SAME

(75) Inventors: Joachim K. Floess, Urbana, IL (US); Dmitry Fomitchev, Lexington, MA (US); Hairuo Tu, Boxborough, MA (US); William R. Williams, Reading, MA (US)

(73) Assignee: Cabot Corporation, Boston, MA (US)

( * ) Notice: Subject to any disclaimer, the term of this patent is extended or adjusted under 35 U.S.C. 154(b) by 1183 days.

(21) Appl. No.: 11/432,942

(22) Filed: May 12, 2006

(65) Prior Publication Data

US 2007/0264502 A1 Nov. 15, 2007

(51) Int. Cl.
*G03G 9/113* (2006.01)

(52) U.S. Cl. ..... 430/108.6; 430/108.1; 430/108.7; 430/137.11

(58) Field of Classification Search ..... 430/108.1, 430/108.6, 108.7, 137.11
See application file for complete search history.

(56) References Cited

U.S. PATENT DOCUMENTS

| | | | | |
|---|---|---|---|---|
| 5,332,639 | A * | 7/1994 | Nakamura et al. | 430/108.6 |
| 5,422,214 | A | 6/1995 | Akiyama et al. | |
| 5,424,129 | A * | 6/1995 | Lewis et al. | 428/403 |
| 5,989,768 | A * | 11/1999 | Little | 430/108.24 |
| 6,214,507 | B1 | 4/2001 | Sokol et al. | |
| 6,251,555 | B1 * | 6/2001 | Hayashi et al. | 430/106.2 |
| 6,479,206 | B1 | 11/2002 | Suzuki et al. | |
| 6,576,389 | B2 | 6/2003 | Vanbesien et al. | |
| 6,620,508 | B2 | 9/2003 | Inoue et al. | |
| 6,746,808 | B2 | 6/2004 | Nakamura et al. | |
| 2002/0005145 | A1 * | 1/2002 | Sherman | 106/436 |
| 2003/0073024 | A1 | 4/2003 | Vanbesien et al. | |
| 2003/0129516 | A1 | 7/2003 | Nakamura et al. | |
| 2004/0229040 | A1 | 11/2004 | Kudo et al. | |
| 2005/0058924 | A1 * | 3/2005 | Miyakawa | 430/108.6 |

FOREIGN PATENT DOCUMENTS

| | | | |
|---|---|---|---|
| JP | 57 158656 A | | 9/1982 |
| JP | 2002-029730 | * | 1/2002 |

OTHER PUBLICATIONS

Translation of JP 2002-029730 published Jan. 2002.*
Barringer et al., "High-Purity, Monodisperse $TiO_2$ Powders by Hydrolysis of Titanium Tetraethoxide. 2. Aqueous Interfacial Electrochemistry and Dispersion Stability," *Langmuir*. 1(4): 420-428 (1985).
Brunauer et al., "Adsorption of Gases in Multimolecular Layer," *The Journal of the American Chemical Society*, 40: 309-319 (Feb. 1938).
Iller, "Polymerization of Silica," *The Chemistry of Silica*, 173-311 (Wiley & Sons, New York, NY, 1979).
Kim et al., "Synthesis and Characterization of Titania-Coated Silica Fine Particles by Semi-Batch Process," *Colloids and Surfaces A: Physicochem. Eng. Aspects*, 224: 119-126 (2003).
Ryu et al., "Deposition of Titania Nanoparticles on Spherical Silica," *Journal of Sol-Gel Science and Technology*, 26: 489-493 (2003).
Tatsuda et al., "Penetration of Titanium Tetraisopropoxide into Mesoporous Silica Using Supercritical Carbon Dioxide," *Chemistry of Materials*, 16(9): 1799-1805 (2004).
International Preliminary Report on Patentability dated Nov. 27, 2008, with respect to PCT/US2007/011374.

* cited by examiner

*Primary Examiner* — Peter Vajda

(57) ABSTRACT

The invention provides a toner composition comprising toner particles and composite metal oxide particles comprising a core consisting of a first metal oxide and a coating consisting of a second metal oxide. The core is substantially spherical and non-aggregated. The invention also provides a method for the preparation of a toner composition.

28 Claims, 2 Drawing Sheets

TONER COMPOSITION AND METHOD OF PREPARING SAME

FIELD OF THE INVENTION

The invention pertains to toner compositions for developing electrostatic latent images and processes for preparing such toner compositions.

BACKGROUND OF THE INVENTION

In order to obtain high image quality, the toner used in an electrophotographic process must have sufficient fluidity. The flow characteristics of the toner are critical to the developing step and the cleaning step. Thus, the toner must be in the form of discrete particles and not agglomerates. A common strategy for controlling and maintaining the fluidity of toner is to add metal oxide particles, such as silica, alumina, and titania, thereto.

Spherical or substantially spherical metal oxide particles are most efficient at improving the fluidity of toner. See, for example, U.S. Pat. Nos. 5,422,214 and 6,479,206. Substantially spherical metal oxide particles act as intervening spacers and reduce the adhesion force between the toner particles by increasing the distance and decreasing the contact area between the toner particles, thereby reducing agglomeration. Preferably, the substantially spherical metal oxide particles are nearly the same size, i.e., diameter, as the toner particles to produce a stable toner composition that does not separate into component toner particles and metal oxide particles.

Additional properties of the metal oxide particles, such as surface area, tribo-charging, and environmental stability, also contribute to the performance of the toner composition. One useful approach for customizing the properties of metal oxide particles for use in toner compositions is to prepare composite metal oxide particles that contain a metal oxide core with a metal oxide a coating. The composite metal oxide particles advantageously combine the preferred properties of the core and the coating.

However, a need still exists for suitable toner compositions and for relatively simple and economical methods of preparing the same. The invention provides such a composition and method. These and other advantages of the invention will be apparent from the description of the invention provided herein.

BRIEF SUMMARY OF THE INVENTION

The invention provides a toner composition comprising (a) toner particles and (b) composite metal oxide particles comprising (i) a core consisting of a first metal oxide, wherein the core is substantially spherical and non-aggregated and has a surface, and (ii) a coating consisting of a second metal oxide, wherein the coating is adhered to the surface of the core, the coating is a continuous or non-continuous, and the second metal oxide is identical to or different from the first metal oxide, with the proviso that the second metal oxide is not identical to the first metal oxide if the coating is continuous.

The invention also provides a method for the preparation of a toner composition. The inventive method comprises (a) forming composite metal oxide particles in water, wherein the composite metal oxide particles comprise (i) a core consisting of a first metal oxide, wherein the core is substantially spherical and non-aggregated and has a surface, and (ii) a coating consisting of a second metal oxide, wherein the coating is adhered to the surface of the core, the coating is continuous or non-continuous, and the second metal oxide is identical to or different from the first metal oxide, with the proviso that the second metal oxide is not identical to the first metal oxide if the coating is continuous, by either (i) adding a metal alkoxide to an aqueous colloidal metal oxide dispersion comprising metal oxide particles or (ii) adding an aqueous colloidal metal oxide dispersion comprising particles of a first metal oxide to an acidic solution of a second metal oxide, (b) isolating the composite metal oxide particles, and (c) combining the composite metal oxide particles with toner particles to provide a toner composition.

BRIEF DESCRIPTION OF THE SEVERAL VIEWS OF THE DRAWING(S)

DETAILED DESCRIPTION OF THE INVENTION

Figure 1:
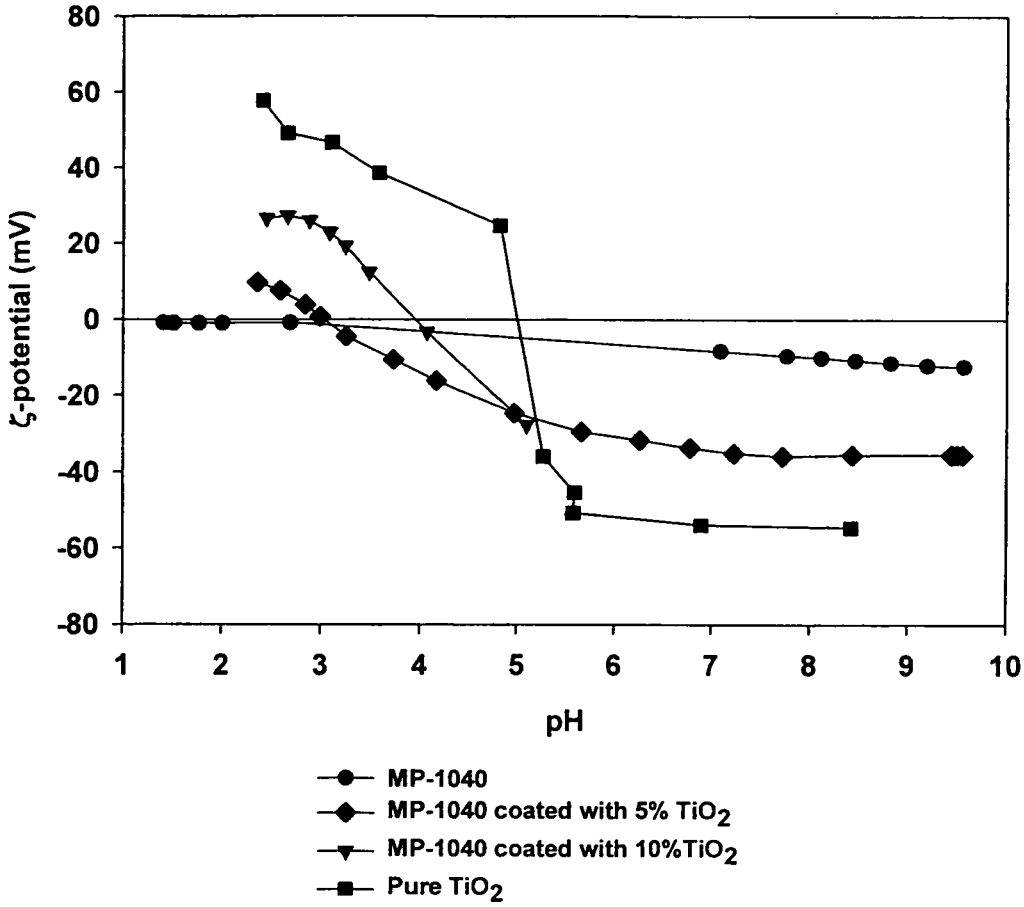
FIG. 1 is a graph of the ζ-potential of colloidal particles.

The invention provides a toner composition. The toner composition comprises toner particles and composite metal oxide particles. The composite metal oxide particles comprise a core consisting of a first metal oxide and a coating consisting of a second metal oxide. The core is substantially spherical and non-aggregated and has a surface. The coating is adhered to the surface of the core. The coating can be continuous or non-continuous. The second metal oxide is identical to or different from the first metal oxide, with the proviso that the second metal oxide is not identical to the first metal oxide if the coating is continuous. The invention also provides a method for the preparation of a toner composition.

The toner particles can be any suitable toner particles. Suitable toner particles typically comprise a colorant and a binder resin.

The colorant can be any suitable colorant. A wide range of colored pigments, dyes, or combinations of pigments and dyes can be used as the colorant. The colorant can be blue, brown, black such as carbon black, cyan, green, violet, magenta, red, yellow, as well as mixtures thereof. Suitable classes of colored pigments and dyes include, for example, anthraquinones, phthalocyanine blues, phthalocyanine greens, diazos, monoazos, pyranthrones, perylenes, heterocyclic yellows, quinacridones, and (thio)indigoids. The colorant can be present in any suitable amount, e.g., an amount sufficient to provide the desired color to the toner composition. Generally, the colorant is present in an amount of about 1% by weight to about 30% by weight of the toner composition; however, lesser or greater amounts of the colorant can be utilized.

The binder resin can be any suitable binder resin. Illustrative examples of suitable binder resins include polyamides, polyolefins, styrene acrylates, styrene methacrylates, styrene butadienes, crosslinked styrene polymers, epoxies, polyurethanes, vinyl resins, including homopolymers or copolymers of two or more vinyl monomers, polyesters, and mixtures thereof. In particular, the binder resin can include (a) homopolymers of styrene and its derivatives and copolymers thereof such as polystyrene, poly-p-chlorostyrene, polyvinyltoluene, styrene-p-chlorostyrene copolymer, and styrene-vinyltoluene copolymer, (b) copolymers of styrene and acrylic acid ester such as styrenemethyl acrylate copolymer, styrene-ethyl acrylate copolymer, styrene-n-butyl acrylate copolymer, and styrene-2-ethylhexyl acrylate copolymer, (c) copolymers of styrene and methacrylic acid ester such as styrene-methyl methacrylate, styrene-ethyl methacrylate, styrene-n-butyl methacrylate, and styrene-2-ethylhexyl methacrylate, (d) multi-component copolymers of styrene, acrylic acid ester, and methacrylic acid ester, (e) styrene copolymers of styrene with other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, and styrene-maleic acid ester copolymer, (f) polymethyl methacrylate, polybutyl methacrylate, polyvinyl acetate, polyvinyl butyral, polyacrylic acid resin, phenolic resin, aliphatic or alicyclic hydrocarbon resin, petroleum resin, and chlorin paraffin, and (g) mixtures thereof. Other types of suitable binder resins are known to those skilled in the art. The binder resin can be present in any suitable amount, typically about 60 wt % to about 95 wt % (e.g., about 65 wt % to about 90 wt %, or about 70 wt % or about 85 wt %) of the toner composition.

The composite metal oxide particles can be present in any suitable amount in the toner composition. The composite metal oxide particles can be present in an amount of about 0.01 wt % or more (e.g., about 0.05 wt % or more, about 0.1 wt % or more, about 0.5 wt % or more, about 1 wt % or more, about 2 wt % or more, about 3 wt % or more, about 4 wt % or more, or about 5 wt % or more) based on the total weight of the toner composition. In addition, the composite metal oxide particles can be present in an amount of about 25 wt % or less (e.g., about 15 wt % or less, about 12 wt % or less, about 10 wt % or less, about 8 wt % or less, about 6 wt % or less, about 5 wt % or less, or about 4 wt % or less) based on the total weight of the toner composition. For example, the composite metal oxide particles can be present in an amount of about 0.01 wt % to about 25 wt % (e.g., about 0.1 wt % to about 15 wt %, or about 0.5 wt % or about 12 wt %) based on the total weight of the toner composition.

Optional additives can be present in the toner composition, such as, for example, magnetic material; carrier additives; positive or negative charge controlling agents such as quaternary ammonium salts, pyridinum salts, sulfates, phosphates, and carboxylates; flow aid additives; silicone oils; waxes such as commercially available polypropylenes and polyethylenes; and other known additives. Generally, these additives are present in an amount of about 0.05 wt % to about 30 wt % (e.g., about 0.1 wt % to about 25 wt %, or about 1 wt % to about 20 wt %) of the toner composition; however, lesser or greater amounts of the additives can be utilized depending on the particular system and desired properties.

The composite metal oxide particles comprise a core consisting of a first metal oxide and a coating consisting of a second metal oxide. The core is substantially spherical and non-aggregated. The coating can be continuous, or the coating can be non-continuous, i.e., discontinuous or not continuous. A continuous coating is a coating that covers the entire surface of the core.

The first and second metal oxides can be any suitable metal oxides, such as a metal oxides selected from the group consisting of main group metal oxides, such as Group III and Group IV metal oxides, and transition metal oxides. Preferably, the first and second metal oxides are independently selected from the group consisting of silica, alumina, titania, tin oxide, zinc oxide, and cerium oxide. More preferably, the first and second metal oxides are independently selected from the group consisting of silica, alumina, and titania. The first and second metal oxides can have any suitable crystalline form, or mixture of crystalline forms, or can be amorphous. Desirably, the first and second metal oxides are about 80 vol % or more (e.g., about 85 vol % or more, about 90 vol % or more, about 95 vol % or more, about 98 vol % or more, or about 99 vol % or more) amorphous. Preferably, the first and second metal oxides are entirely or substantially amorphous.

The first metal oxide can be identical to or different from the second metal oxide. When the coating is continuous, however, then the first metal oxide is different from the second metal oxide. For example, the core can be silica, and the coating can be titania when the coating is continuous or non-continuous, or the coating can be silica when the coating is non-continuous. Similarly, the core can be alumina, and the coating can be alumina or titania when the coating is continuous or non-continuous, or the coating can be titania when the coating is non-continuous. There typically will exist a boundary or demarcation line between the core and the coating, thereby evidencing that the distinctiveness of the core and the coating. The coating is directly adhered to the surface of the core, with no intermediary material or substance between the core and the coating adhered to the surface of the core.

When the coating consists of a second metal oxide different from the first metal oxide, the composite metal oxide particles advantageously combines the properties of the individual metal oxides. For example, silica has a high tribo-charging property but poor humidity resistance. Alumina has a poor tribo-charging property but good humidity resistance. Titania has a good tribo-charging property and good humidity resistance, but has a poor reflective index that interferes with the color of the developed toner. Thus, composite metal oxide particles comprising a silica core and a titania coating can have high tribo-charging as determined by the surface (coating) composition and good reflective index as determined by the bulk (core) composition. Similarly, composite metal oxide particles comprising an alumina core and a titania coating can have high tribo-charging as determined by the surface (coating) composition and good humidity resistance as determined by the bulk (core) composition.

The core is spherical or substantially spherical. The sphericalness of the core can be determined by the ratio of $D_{max}/D_{min}$, wherein $D_{max}$ is the longest diameter of the core and $D_{min}$ is the shortest diameter of the core. Preferably, the core has a $D_{max}/D_{min}<1.4$ (e.g., $D_{max}/D_{min}<1.3$, $D_{max}/D_{min}<1.2$, or $D_{max}/D_{min}<1.1$), and ideally the core has a $D_{max}/D_{min}=1$.

The core can have any suitable average particle diameter. The core can have an average particle diameter of about 5 nm or more (e.g., about 10 nm or more, about 20 nm or more, about 30 nm or more, about 35 nm or more, about 50 nm or more, or about 100 nm or more). The core can have an average particle diameter of about 400 nm or less (e.g., about 350 nm or less, about 300 nm or less, about 250 nm or less, about 240 nm or less, about 200 nm or less, about 150 nm or less, or about 100 nm or less). For example, the core can have an average particle diameter of about 5 nm to about 400 nm (e.g., about 10 nm to about 350 nm, or about 35 nm to about 240 nm).

The term "average particle diameter" is the average of the diameter of the smallest spheres that encompass the particles. The average particle diameter of particles can be measured by any suitable technique, desirably by (a) dispersing the particles in THF and exposing the particles in the THF to ultrasound for at least one 1 minute and then (b) utilizing dynamic light scattering to determine the average particle diameter of the particles.

The core is non-aggregated. The term "non-aggregated," as used herein, refers to metal oxide particles that are discrete, or primary, particles having no internal surface area. In contrast, aggregated metal oxide particles are comprised of discrete particles that are fused together into three-dimensional, chain like aggregates.

The coating can be continuous. When the coating is continuous, the coating can have any suitable thickness. The coating can have a thickness of about 0.1 nm or more (e.g., about 0.2 nm or more, about 0.3 nm or more, about 0.5 nm or more, about 1 nm or more, about 2 nm or more, about 3 nm or more, about 5 nm or more, or about 10 nm or more). The coating can have a thickness of about 150 nm or less (e.g., about 140 nm or less, about 100 nm or less, about 75 nm or less, about 50 nm or less, about 25 nm or less, about 15 nm or less, or about 10 nm or less). For example, the coating can have a thickness of about 0.1 nm to about 150 nm (e.g., about 0.2 nm to about 140 nm, about 0.5 nm to about 100 nm, or about 1 nm to about 15 nm).

The coating can be non-continuous. When the coating is non-continuous, the coating typically will be comprised of discrete particles adhered to the surface of the core, thereby leaving exposed portions of the surface of the core, i.e., portions of the core that are not in contact with the coating. The particles of the non-continuous coating can have any suitable geometric mean diameter. The particles of a non-continuous coating can have a geometric mean diameter of about 1 nm or more (e.g., about 2 nm or more, about 3 nm or more, about 4 nm or more, or about 5 nm or more). The particles of a non-continuous coating can have a geometric mean diameter of about 10 nm or less (e.g., about 9 nm or less, about 8 nm or less, about 7 nm or less, or about 6 nm or less). For example, the particles of a non-continuous coating can have a geometric mean diameter of about 1 nm to about 10 nm (e.g., about 2 nm to about 8 nm). A composite metal oxide particle comprising a non-continuous coating on the core typically will have a higher surface area than a composite metal oxide particle comprising a continuous coating on the core. Preferably, the non-continuous coating adds to the surface area of the core with only a relatively minimal contribution (e.g., about 20% or less, about 10% or less, about 5% or less, or about 2% or less) to the particle diameter of the composite metal oxide particles. Thus, composite metal oxide particles comprising a silica core and a silica non-continuous coating desirably have a similar diameter to the silica core alone but with a significantly higher surface area (e.g., about 20% or more, about 30% or more, about 50% or more, about 100% or more, or about 200% or more) than the silica core alone.

The thickness of the coating can be determined by standard methods. The thickness can be determined by transmission electron microscopy (TEM) or, in some situations, with X-ray powder diffraction (XRD).

The coating can be any suitable proportion of the composite metal oxide particles. The coating can be about 1 wt % or more (e.g., about 5 wt % or more, about 10 wt % or more, about 20 wt % or more, or about 30 wt % or more) of the composite metal oxide particles. The coating can be about 100 wt % or less (e.g., about 80 wt % or less, about 60 wt % or less, about 40 wt % or less, or about 30 wt % or less) of the composite metal oxide particles. For example, the coating can be about 1 wt % to about 60 wt % (e.g., about 1 wt % to about 50 wt %, or about 5 wt % to about 40 wt %) of the composite metal oxide particles.

The composite metal oxide particles can have any suitable average particle diameter. The composite metal oxide particles desirably have an average particle diameter that is substantially similar to the average particle diameter of the core inasmuch as the thickness of the coating desirably does not contribute substantially to the overall diameter of the composite metal oxide particle. Thus, the discussion above with respect to the average particle diameter of the core generally is applicable to the average particle diameter of the composite metal oxide particles.

The composite metal oxide particles desirably have a narrow particle size distribution, i.e., the composite metal oxide particles have similar size or diameter. A method of characterizing the particle size distribution of particles is by reference to the geometric standard deviation, $\sigma_g$, of the size of the particles. The value of $\sigma_g$ is calculated with equation (1):

$$\ln^2\sigma_g = \frac{\sum N_i[\ln(d_{pi}/d_{gn})]^2}{N_\infty} \quad (1)$$

where $d_{pi}$ is the diameter of (i.e., the diameter of the smallest sphere encompassing) the $i^{th}$ particle, and $d_{gn}$ is the geometric mean of the particles. The composite metal oxide particles desirably have a $\sigma_g<1.5$. The composite metal oxide particles preferably have $\sigma_g<1.4$ or even a $\sigma_g<1.3$.

The composite metal oxide particles can have any suitable surface area. The surface area of a particle can be measured by any suitable method known in the art. The surface area of a particle typically is determined by the method of S. Brunauer, P. H. Emmet, and I. Teller, *J. Am. Chemical Society,* 60, 309 (1938), which is commonly referred to as the BET method.

The composite metal oxide particles optionally are surface-treated with a surface treating agent, desirably a hydrophobic treating agent (i.e., a surface treating agent that renders the surface of the composite metal oxide particles hydrophobic). The surface treating agent can be any suitable treating agent, e.g., any suitable hydrophobic treating agent. Suitable treating agents include silyl amine treating agents, silane treating agents, and silane fluorine treating agents.

Any suitable silyl amine treating agent can be used. The silyl amine treating agent can be water-miscible or water-immiscible. Suitable compounds include those of the general formula $(R_3Si)_nNR'_{(3-n)}$ wherein n=1-3; each R is independently selected from the group consisting of hydrogen, a $C_1$-$C_{18}$ alkyl or branched alkyl, a $C_3$-$C_{18}$ haloalkyl, vinyl, a $C_6$-$C_{14}$ aromatic group, a $C_2$-$C_{18}$ alkenyl group, a $C_3$-$C_{18}$ epoxylalkyl group, and linear or branched $C_mH_{2m}X$, wherein m is 1-18; each R' is independently hydrogen, $C_1$-$C_{18}$ alkyl or branched alkyl, or, when n=1, a $C_2$-$C_6$ cyclic alkylene; X is $NR''_2$, SH, OH, $OC(O)CR''{=}CR''_2$, $CO_2R''$, or CN; wherein R" is independently hydrogen, a $C_1$-$C_{18}$ alkyl, a $C_2$-$C_{18}$ unsaturated group, a $C_1$-$C_{18}$ acyl or $C_3$-$C_{18}$ unsaturated acyl group, a $C_2$-$C_6$ cyclic alkylene, or a $C_6$-$C_{18}$ aromatic group. The treating agent also can be a disilane of the general formula $R'_2{-}SiR_2{-}(Z{-}SiR_2)_p{-}NR'_2$ wherein R' is as defined above, Z is $C_1$-$C_{18}$ linear of branched alkylene, O, NR', or S, and p is 0-100. Preferably, each R' is H or $CH_3$. It also is preferred that each R is a $C_1$-$C_{18}$ alkyl or branched alkyl. The silyl amine treating agent can comprise one or more of the above organosilicon compounds. Preferred silyl amine treating agents include but are not limited to vinyldimethylsilylamine, octyldimethylsilylamine, phenyldimethylsilylamine, bisaminodisilane, bis(dimethylaminodimethylsilyl)ethane, hexamethyldisilazane, and mixtures thereof.

The silyl amine treating agent also can comprise, in addition to or instead of the above compounds, one or more cyclic silazanes having the general formula

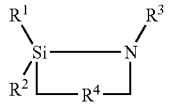

wherein $R^1$ and $R^2$ are independently selected from the group consisting of hydrogen, halogen, alkyl, alkoxy, aryl, and aryloxy; $R^3$ is selected from the group consisting of hydrogen, $(CH_2)_nCH_3$, wherein n is an integer between 0 and 3, $C(O)(CH_2)_nCH_3$, wherein n is an integer between 0 and 3, $C(O)NH_2$, $C(O)NH(CH_2)_nCH_3$, wherein n is an integer between 0 and 3, and $C(O)N[(CH_2)_nCH_3](CH_2)_mCH_3$, wherein n and m are integers between 0 and 3; and $R^4$ is $[(CH_2)_a(CHX)_b(CYZ)_c]$, wherein X, Y, and Z are independently selected from the group consisting of hydrogen, halogen, $C_1$-$C_{10}$ alkyl, $C_1$-$C_{10}$ alkoxy, aryl, and aryloxy, and a, b, and c are integers of 0 to 6 satisfying the condition that (a+b+c) equals an integer of 2 to 6. Suitable cyclic silazanes, and methods of preparing cyclic silazanes, are described in U.S. Pat. No. 5,989,768.

The hydrophobic treating agent also can comprise, in addition to or instead of the above compounds, one or more silanes and/or silane fluorine treating agents having the general formula $$(R^5)_nSiX_{4-n}$$

wherein $R^5$ is selected from the group consisting of $C_1$-$C_{18}$ alkyl, a $C_2$-$C_{18}$ alkenyl, a $C_3$-$C_{18}$ alkynyl, a $C_6$-$C_{14}$ aromatic group, and a $C_6$-$C_{24}$ arylalkyl group, wherein $R_5$ can be unsubstituted or substituted with one or more fluoro groups, and wherein X is selected from the group consisting of halogen and alkoxy, and wherein n is an integer of 1 to 3.

The invention also provides a method for preparing a toner composition, especially the inventive toner composition described herein. The method comprises (a) forming composite metal oxide particles in water, wherein the composite metal oxide particles are as described above, by either (i) adding a metal alkoxide to an aqueous colloidal metal oxide dispersion comprising metal oxide particles or (ii) adding an aqueous colloidal metal oxide dispersion comprising particles of a first metal oxide to an acidic solution of a second metal oxide, (b) isolating the composite metal oxide particles, and (c) combining the composite metal oxide particles with toner particles to provide a toner composition.

The term "colloidal metal oxide dispersion" as used herein refers to a dispersion of colloidal metal oxide particles. The colloidal stability of such a dispersion prevents any substantial portion of the metal oxide particles from irreversibly agglomerating. Agglomeration of metal oxide particles can be detected by an increase in the average overall particle size. Preferably, the colloidal metal oxide dispersion used in conjunction with the invention has a degree of colloidal stability such that the average overall particle size of the colloidal particles as measured by dynamic light scattering (DLS) does not change over a period of 3 weeks or more (e.g., 4 weeks or more, or even 5 weeks or more), more preferably 6 weeks or more (e.g., 7 weeks or more, or even 8 weeks or more), most preferably 10 weeks or more (e.g., 12 weeks or more, or even 16 weeks or more).

The aqueous colloidal metal oxide dispersion can comprise any suitable type of substantially spherical metal oxide particles, such as particles of a metal oxide selected from the group consisting of main group metal oxides, such as Group III and Group IV metal oxides, and transition metal oxides. Suitable metal oxide particles include wet-process type metal oxide particles (e.g., condensation-polymerized silica particles) and precipitated metal oxide particles. Preferably, the metal oxide particles are selected from the group consisting of silica, alumina, titania, tin oxide, zinc oxide, and cerium oxide. More preferably, the metal oxide particles are selected from the group consisting of silica, alumina, and titania.

The colloidal metal oxide particles can have any suitable average particle diameter. Inasmuch as the colloidal metal oxide particles represent the core of the composite metal oxide particles described above, the discussion above with respect to the average particle diameter of the core generally is applicable to the average particle diameter of the colloidal metal oxide particles.

The aqueous colloidal metal oxide dispersion can comprise any suitable amount of the colloidal metal oxide particles. The metal oxide particles can be about 5 wt % or more (e.g., about 10 wt % or more, about 20 wt % or more, about 25 wt % or more, about 30 wt % or more, about 35 wt % or more, or about 40 wt % or more) of the aqueous colloidal metal oxide dispersion. The metal oxide particles can be about 70 wt % or less (e.g., about 65 wt % or less, about 60 wt % or less, about 50 wt % or less, about 45 wt % or less, or about 40 wt % or less) of the aqueous colloidal metal oxide dispersion. For example, the metal oxide particles can be about 5 wt % to about 70 wt % (e.g., about 10 wt % to about 65 wt %, about 15 wt % to about 60 wt %, about 20 wt % to about 50 wt %, or about 25 wt % to about 45 wt %) of the aqueous colloidal metal oxide dispersion.

When the composite metal oxide particles in water are formed by adding a metal alkoxide to an aqueous colloidal metal oxide dispersion comprising metal oxide particles, the metal alkoxide can be any suitable metal alkoxide, which can be added to the aqueous colloidal metal oxide dispersion in any suitable manner. In general, a solution of a metal alkoxide with the general formula $M(OR^6)_q$, wherein q is an integer of 3 or 4, and wherein $R^6$ is a $C_1$-$C_{15}$ branched or straight chain alkyl group (preferably methyl, ethyl, n-propyl, n-butyl, t-butyl, or iso-propyl), is added to an aqueous colloidal metal oxide dispersion at a neutral pH. The mixture is stirred or agitated until the composite metal oxide particles have formed. The metal element of the metal alkoxide can be any suitable metal such as a metal selected from the group consisting of main group metals and transition metals. Preferably, the metal element of the metal alkoxide is selected from the group consisting of silicon, aluminum, titanium, tin, zinc, and cerium. More preferably, the metal element of the metal alkoxide is selected from the group consisting of silicon, aluminum, and titanium. The metal of the metal alkoxide can be identical to or different from the metal of the colloidal metal oxide. The solution of metal alkoxide can comprise any suitable solvent. Preferably, the solvent comprises or consists of an alcohol.

When the composite metal oxide particles in water are formed by adding an aqueous colloidal metal oxide dispersion comprising particles of a first metal oxide to an acidic solution of a second metal oxide, the first metal oxide and second metal oxide can be any suitable metal oxides as discussed above with respect to toner composition of the invention, and the addition of the first metal oxide to the acid solution of the second metal oxide can be carried out in any suitable manner. In general, a first metal oxide with the general formula $M_xO_y$, wherein x is an integer of 1 or 2, and y is an integer of 2 or 3, is dissolved in an aqueous acid to form a sol. Any suitable acid can be used, including but not limited to nitric acid, hydrochloric acid, sulfuric acid, and phosphoric acid. Preferably, the acid is nitric acid. The aqueous colloidal metal oxide dispersion, which comprises particles of a second metal oxide, is added to the sol. The pH of the solution is adjusted to a pH of 3 to 6, or more preferably 4 to 5, by adding a dilute base. The mixture is stirred or agitated until the composite metal oxide particles have formed. The metal elements of the first and second metal oxides can be any suitable metals, such as metals selected from the group consisting of main group metals and transition metals. Preferably, the metal elements of the first and second metal oxides are independently selected from the group consisting of silicon, aluminum, titanium, tin, zinc, and cerium. More preferably, the metal elements of the first and second metal oxides are independently selected from the group consisting of silicon, aluminum, and titanium. The first metal oxide can be identical to or different from the second metal oxide.

The reaction mixture comprising the aqueous colloidal metal oxide dispersion in combination with either the metal alkoxide or the acidic solution of the metal oxide can be maintained at any temperature that is suitable for the formation of the composite metal oxide particles. Generally, the reaction mixture is maintained at a temperature of about 5-100° C., such as about 15-80° C., or about 20-50° C., for about 5 minutes or longer (e.g., about 30 minutes or longer), or even about 60 minutes or longer (e.g., about 120 minutes or longer, or about 180 minutes or longer). Longer reaction times (e.g., 5 hours or more, 10 hours or more, or even 20 hours or more) may be required depending on the particular reaction conditions.

Any suitable method can be used to isolate the composite metal oxide particles from the reaction mixture. Suitable methods include filtration and centrifugation.

The composite metal oxide particles can be washed. Washing the composite metal oxide particles can be performed using a suitable washing solvent, such as water, a water-miscible organic solvent, or a mixture thereof. The washing solvent can be added to the reaction mixture, and the resulting mixture suitably mixed, followed by filtration or centrifugation to isolate the washed composite metal oxide particles. Alternatively, the composite metal oxide particles can be isolated from the reaction mixture prior to washing. The washed composite metal oxide particles can be further washed with additional washing steps followed by additional filtration and/or centrifugation steps.

The composite metal oxide particles optionally are surface-treated with a surface treating agent as described above. When surface-treated composite metal oxide particles are desired, the inventive method as described above further comprises isolating the composite metal oxide particles in step (b) without completely drying the composite metal oxide particles, and then, before step (c), preparing an aqueous colloidal dispersion comprising the composite metal oxide particles, combining the aqueous colloidal dispersion of the composite metal oxide particles with a surface treating agent to thereby form surface-treated composite metal oxide particles, and drying the surface-treated composite metal oxide particles before combining the surface-treated composite metal oxide particles with the toner particles to provide the toner composition. It is essential that the composite metal oxide particles are not completely dried prior to being redispersed, so as to prevent aggregation or agglomeration of the particles comprising the aqueous colloidal composite metal oxide dispersion.

The terms "dry" and "dried" as used herein with reference to the composite metal oxide particles mean substantially or completely free of the liquid components of the reaction mixture, including water and other liquid-phase solvents, reactants, by-products, and any other liquid component that may be present. Similarly, the term "drying" as used herein refers to the process of removing the liquid components of the reaction mixture from the surface-treated composite metal oxide particles.

The isolated composite metal oxide particles can be redispersed in any suitable manner in an aqueous solution to provide the aqueous colloidal composite metal oxide dispersion that is subjected to surface treatment, e.g., in order to render the surface of the composite metal oxide hydrophobic. The type of surface treating agent and level of treatment will vary depending upon the desired degree of hydrophobicity and other characteristics. The surface treating agent can be any suitable surface treating agent as described above with respect to the toner composition of the invention. Preferably, the surface treating agent is selected from the group consisting of silyl amine treating agents, silane treating agents, and silane fluorine treating agents.

Any suitable amount of the surface treating agent can be used in the context of the inventive method. Generally, the desired amount of surface treating agent used in the inventive method is based on the BET surface area of the composite metal oxide particles. The amount of the surface treating agent, therefore, is expressed in terms of μmole of surface treating agent per square meter ($m^2$) of surface area of the composite metal oxide particles (based on the BET surface area of the composite metal oxide particles), which is abbreviated for the purposes of this invention as "μmole/$m^2$." Any suitable amount of surface treating agent can be used in the inventive method. Desirably, about 3 μmole/$m^2$ or more (e.g., about 5 μmole/$m^2$ or more) of the surface treating agent is used. However, more of the surface treating agent can be used to ensure more complete contact and treatment of the composite metal oxide particles with the surface treating agent. Thus, about 9 μmole/$m^2$ or more (e.g., about 12 μmole/$m^2$ or more) or even about 30 μmole/$m^2$ or more (e.g., about 36 μmole/$m^2$ or more) of the surface treating agent can be used. Although there is no theoretical limit on the maximum amount of surface treating agent to be used, it is advisable to limit the amount of the surface treating agent in order to reduce the amount of organic impurities present in the surface-treated composite metal oxide particles, and to avoid costly waste of the surface treating agent. Thus, the amount of surface treating agent used typically will be about 75 μmole/$m^2$ or less (e.g., about 50 μmole/$m^2$ or less), such as about 36 μmole/$m^2$ or less (e.g., about 20 μmole/$m^2$ or less), or even about 9 μmole/$m^2$ or less (e.g., about 7 μmole/$m^2$ or less). Preferably, the amount of the surface treating agent used is within the range of about 3-75 μmole/$m^2$ (e.g., about 3-36 μmole/$m^2$), such as about 6-36 μmole/$m^2$ (e.g., about 6-18 μmole/$m^2$ or about 9-18 μmole/$m^2$). The concentration of composite metal oxide particles in the dispersion also is a factor in the determination of the desired amount of surface treating agent used. Lower concentrations of composite metal oxide particles typically necessitate larger amounts of surface treating agent, within the bounds described above.

The aqueous colloidal composite metal oxide dispersion and the surface treating agent can be combined to provide a surface treatment reaction mixture by any suitable method. Preferably, the surface treating agent and the aqueous colloidal composite metal oxide dispersion are combined with mixing or agitation to facilitate contact between the composite metal oxide particles and the surface treating agent. Mixing or agitation is especially important if the surface treating agent is water-immiscible, in which situation the surface treatment reaction mixture will comprise an aqueous phase comprising the untreated colloidal composite metal oxide dispersion particles, and a non-aqueous phase comprising the surface treating agent. Mixing or agitation can be accomplished by any method, such as by using a mixing or agitating device. Examples of suitable devices include paddle stirrers, radial flow or axial flow impellers, homogenizers, ball mills, jet mills, and similar devices.

The surface treatment reaction mixture can be maintained at any temperature that allows the surface treating agent to react with the aqueous colloidal composite metal oxide dispersion (e.g., to react with the hydroxy groups on the surface of the composite metal oxide particles). Generally, the reaction mixture is maintained at a temperature of about 5-100° C., such as about 15-80° C., or about 20-50° C., for about 5 minutes or longer (e.g., about 30 minutes or longer), or even about 60 minutes or longer (e.g., about 120 minutes or longer, or about 180 minutes or longer). Longer reaction times (e.g., 5 hours or more, 10 hours or more, or even 20 hours or more) may be required depending on the particular reaction conditions (e.g., temperature and concentration of reagents).

The surface treatment reaction mixture can be contained in an open or closed reactor. While the surface treatment can be carried out in air, oxygen is preferably excluded from the reaction atmosphere. The surface treatment reaction desirably is conducted under an atmosphere consisting essentially of nitrogen, argon, carbon dioxide, or a mixture thereof.

In order to facilitate the reaction between the surface treating agent and the composite metal oxide particles of the aqueous colloidal composite metal oxide dispersion, the surface treatment reaction mixture desirably has a pH of about 7 or more (e.g., about 8 or more), such as about 9 or more (e.g., about 10 or more). Preferably the pH is about 7-11 (e.g., about 9-11). The pH of the surface treatment reaction mixture may be altered by the addition of acids, bases, buffers, or materials that may react in situ to release acidic or basic substances. For example, trimethylchlorosilane can be added to the surface treatment reaction mixture to lower the pH by the evolution of hydrochloric acid. Likewise, a buffering salt such as ammonium bicarbonate can be added to the surface treatment reaction mixture to maintain the pH at a different level.

The surface treatment reaction mixture desirably comprises about 50 wt % or less (e.g., about 20 wt % or less, about 15 wt % or less, about 10 wt % or less, about 5 wt % or less, or about 1 wt % or less) of an organic solvent. The surface treatment reaction mixture preferably is free of an organic solvent. Thus, the surface treatment reaction mixture can consist essentially of the aqueous colloidal composite metal oxide dispersion and the surface treating agent, along with any resulting reaction by-products. Within these guidelines, however, a small amount of an organic solvent can be used in the surface treatment reaction mixture. Suitable organic solvents include water-immiscible and water-miscible organic solvents, preferably in which the surface treating agent is at least partially soluble. Non-limiting examples of suitable water-immiscible organic solvents include dichloromethane, dichloroethane, tetrachloroethane, benzene, toluene, heptane, octane, cyclohexane, and similar solvents. Suitable water-miscible organic solvents include alcohols (e.g., tetrahydrofuran, methanol, ethanol, isopropanol, etc.), acetone, and similar solvents.

The surface-treated composite metal oxide particles can be isolated and dried from the surface treatment reaction mixture. Any suitable method can be used to isolate the surface-treated composite metal oxide particles from the surface treatment reaction mixture. Suitable methods include filtration and centrifugation. The surface-treated composite metal oxide particles can be isolated from the surface treatment reaction mixture prior to drying, or the surface-treated composite metal oxide particles can be dried directly from the surface treatment reaction mixture, e.g., by evaporating the volatile components of the surface treatment reaction mixture from the surface-treated composite metal oxide particles. Evaporation of the volatile components of the surface treatment reaction mixture can be accomplished using heat and/or reduced atmospheric pressure. When heat is used, the surface-treated composite metal oxide particles can be heated to any suitable drying temperature, for example, using an oven or other similar device. The drying temperature chosen will depend, at least in part, on the specific components of the surface treatment reaction mixture that require evaporation. The drying temperature can be about 40° C. or higher (e.g., about 50° C. or higher, about 70° C. or higher, about 80° C. or higher, about 120° C. or higher, or about 130° C. or higher). The drying temperature can be about 250° C. or lower (e.g., about 200° C. or lower, about 175° C. or lower, about 150° C. or lower, or about 130° C. or lower). For example, the drying temperatures can be about 40-250° C. (e.g., about 50-200° C., about 60-200° C., about 70-175° C., about 80-150° C., or about 90-130° C.).

The surface-treated composite metal oxide particles can be dried at any pressure that will provide a useful rate of evaporation. When drying temperatures of about 120° C. and higher (e.g., about 120-150° C.) are used, drying pressures of about 125 kPa or less (e.g., about 75-125 kPa) are suitable. At drying temperatures lower than about 120° C. (e.g., about 40-120° C.), drying pressures of about 100 kPa or less (e.g., about 75 kPa or less) are useful. Of course, reduced pressure (e.g., pressures of about 100 kPa or less, 75 kPa or less, or even 50 kPa or less) can be used as a sole method for evaporating the volatile components of the surface treatment reaction mixture.

The surface-treated composite metal oxide particles also can be dried by other methods. For example, spray drying can be used to dry the hydrophobic composite metal oxide particles. Spray drying involves spraying the surface treatment reaction mixture, or some portion thereof, comprising the surface-treated composite method oxide particles as a fine mist into a drying chamber, wherein the fine mist is contacted with hot air causing the evaporation of volatile components of the surface treatment reaction mixture. Alternatively, the surface-treated composite metal oxide particles can be dried by lyophilization, wherein the liquid components of the surface treatment reaction mixture are converted to a solid phase (i.e., frozen) and then to a gas phase by the application of a vacuum. For example, the surface treatment reaction mixture comprising the surface-treated composite metal oxide particles can be brought to a suitable temperature (e.g., about −20° C. or less, or about −10° C. or less, or even −5° C. or less) to freeze the liquid components of the surface treatment reaction mixture, and a vacuum can be applied to evaporate those components of the surface treatment reaction mixture to provide dry surface-treated composite metal oxide particles.

The surface-treated composite metal oxide particles can be washed prior to or as part of the isolation of the surface-treated composite metal oxide particles from the surface treatment reaction mixture. Washing the surface-treated metal oxide particles can be performed using a suitable washing solvent, such as water, a water-miscible organic solvent, a water-immiscible solvent, or a mixture thereof. The washing solvent can be added to the surface treatment reaction mixture, and the resulting mixture can be suitably mixed, followed by filtration, centrifugation, or drying to isolate the washed surface-treated composite metal oxide particles. Alternatively, the surface-treated composite metal oxide particles can be isolated from the surface treatment reaction mixture prior to washing. The washed surface-treated composite metal oxide particles can be further washed with additional washing steps followed by additional filtration, centrifugation, and/or drying steps.

The surface-treated composite metal oxide particles have particle size characteristics that are dependent, at least in part, on the particle size characteristics of the composite metal oxide particles of the initial colloidal metal oxide dispersion.

The particle size of the surface-treated composite metal oxide particles can be further reduced, if desired. Suitable processes for the reduction of the particle size of the surface-treated composite metal oxide particles include but are not limited to grinding, hammer milling, and jet milling.

The composite metal oxide particles that are either surface-treated or not surface-treated as described herein can be combined with toner particles to provide a toner composition. Any suitable toner particles can be used in accordance with this method, and suitable toner particles are described above with respect to the toner composition of the invention. The method of preparing a toner composition optionally further comprises the addition of other components to the mixture of the toner particles and the composite metal oxide particles that are either surface-treated or not surface-treated as described herein.

Conventional equipment for dry blending of powders can be used for mixing or blending the composite metal oxide particles with toner particles to form a toner composition.

The toner composition can be prepared by a number of known methods, such as admixing and heating the composite metal oxide particles, the colorants, the binder resin, and optional charge-enhancing additives and other additives in conventional toner extrusion devices and related equipment. Other methods include spray drying, melt dispersion, extrusion processing, dispersion polymerization, and suspension polymerization, optionally followed by mechanical attrition and classification to provide toner particles having a desired average size and a desired particle size distribution.

The toner composition can be used alone in mono-component developers or can be mixed with suitable dual-component developers. The carrier vehicles which can be used to form developer compositions can be selected from various materials. Such materials typically include carrier core particles and core particles overcoated with a thin layer of film-forming resin to help establish the correct triboelectric relationship and charge level with the toner employed. Suitable carriers for two-component toner compositions include iron powder, glass beads, crystals of inorganic salts, ferrite powder, and nickel powder, all of which are typically coated with a resin coating such as an epoxy or fluorocarbon resin.

The following examples further illustrate the invention but, of course, should not be construed as in any way limiting its scope.

EXAMPLE 1

This example illustrates the preparation of composite metal oxide particles by treating colloidal silica with a titanium alkoxide in accordance with the invention.

$TiO_2$-coated colloidal silica particles were prepared from commercially available colloidal silica (MP-1040 from Nissan Chemical Industries). The colloidal silica dispersion contained 40 wt % $SiO_2$ with an average particle diameter of about 140 nm. The pH of the dispersion was adjusted from about 9.3 to about 7 with 1.0 M hydrochloric acid, and the dispersion was diluted with EtOH to a final concentration of 20 wt % $SiO_2$.

A solution of $Ti(OEt)_4$ and hydroxypropyl cellulose (HPC) in anhydrous EtOH was prepared. The final concentration of $Ti(OEt)_4$ was about 0.05-0.10 M, and the final concentration of HPC was 0.001 g/ml.

The solution of $Ti(OEt)_4$ and HPC was added to the colloidal silica dispersion at a rate of about 1.8-2.2 g/min. The reaction mixture was slowly stirred for about 15-17 hours. The $TiO_2$-coated colloidal silica was separated from the reaction mixture by centrifugation and washed with deionized water two times.

EXAMPLE 2

This example illustrates the preparation of composite metal oxide particles by treating colloidal silica with titanium dioxide in accordance with the invention.

Titanium oxide was formed by adding $Ti(O^iPr)_4$ in excess to deionized water. The precipitated titanium oxide was isolated by filtration and added to deionized water. Concentrated nitric acid was added to the mixture until all of the solid dissolved, yielding a clear sol.

A dispersion of colloidal silica (MP-1040), diluted to a concentration of 10 wt % $SiO_2$, was added to the sol, and the pH of the mixture was adjusted to approximately 4.5 by adding a 1% solution of sodium hydroxide. The mixture was stirred about 3 hours. The $TiO_2$-coated colloidal silica was separated from the reaction mixture by filtration and washed with deionized water two times.

EXAMPLE 3

This example evaluates the composite metal oxide particles prepared according to Example 1.

The ζ-potential of colloidal silica coated with 5 wt % $TiO_2$ and 10 wt % $TiO_2$, prepared according to Example 1 was measured with an ESA9800 Zeta Potential Analyzer (from Matec Applied Sciences). This instrument utilizes Electrokinetic Sonic Amplitude (ESA) effect to determine the ζ-potential of colloidal particles. For comparison, the ζ-potential of colloidal silica particles (MP-1040 particles from Nissan Chemical Industries) and colloidal $TiO_2$ particles also were measured.

The results are depicted in the graph of FIG. 1. The isoelectric points of the colloidal silica particles and colloidal $TiO_2$ particles are in agreement with known literature values. Notably, the isoelectric points of the colloidal silica coated with 5 wt % and 10 wt % $TiO_2$ are shifted toward the isoelectric points of pure $TiO_2$. The resulting data demonstrate that the method of Example 1 results in $TiO_2$-coated colloidal silica.

EXAMPLE 4

This example evaluates the composite metal oxide particles prepared according to Example 1.

Figure 2:
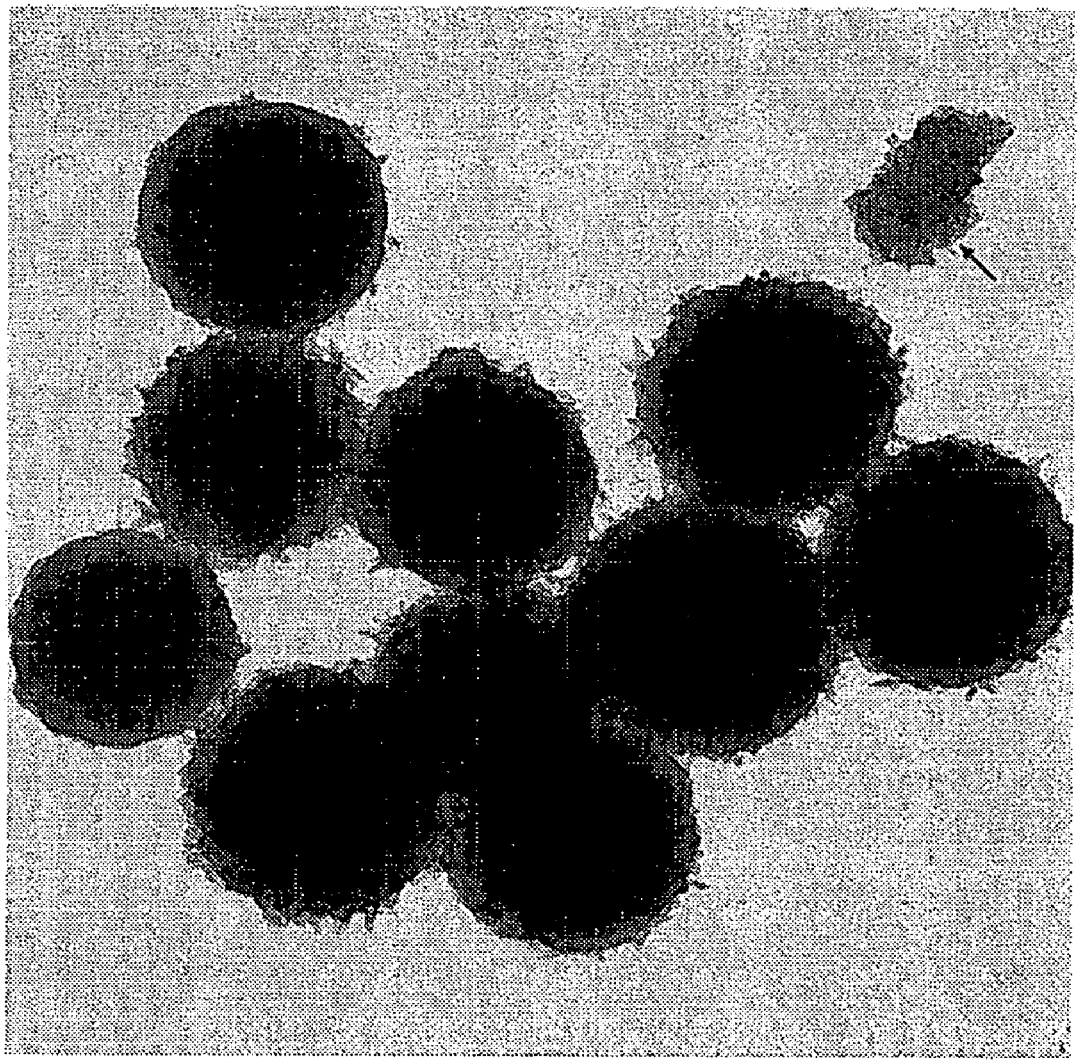
FIG. 2 is a transmission electron microscopy photograph of composite metal oxide particles.

Samples of colloidal silica coated with approximately 10 wt % $TiO_2$ were evaluated with Transmission Electron Microscopy (TEM). FIG. 2 is the TEM photograph of the composite metal oxide particles. Fine $TiO_2$ particles of irregular shape can be distinguished on the surface of the colloidal silica. FIG. 2 demonstrates that the method of Example 1 results in $TiO_2$-coated colloidal silica.

EXAMPLE 5

This example evaluates the composite metal oxide particles prepared according to Example 1 and Example 2.

Samples of colloidal silica coated with approximately 5 wt % $TiO_2$ prepared according to Example 1 (Example 5A), colloidal silica coated with approximately 10 wt % $TiO_2$ prepared according to Example 2 (Example 5B), and uncoated, hydrophobic colloidal silica (MP-1040 particles from Nissan Chemical Industries treated with hexamethyldisilazane) (Example 5C) were subjected to tribocharge measurements. The results are depicted in Table 1.

TABLE 1

Tribocharge Measurements for Colloidal Silica Coated with $TiO_2$

| Sample | $TiO_2$ (wt %) | HH (μC/g) | LL (μC/g) | Delta (%) |
|---|---|---|---|---|
| 5A (invention) | 5 | −33 | −87 | 62 |
| 5A (invention) | 5 | −23 | −75 | 69 |
| 5B (invention) | 10 | −35 | −61 | 43 |
| 5C (comparative) | 0 | −21 | −54 | 61 |

The results demonstrate that the $TiO_2$ coating leads to an increase of absolute values in charge per mass at low temperature and low humidity ("LL") (18° C., 15% relative humidity) and at high temperature and high humidity ("HH") (35° C., 80% relative humidity) conditions in comparison with uncoated colloidal silica. The relative change of charge ("delta") at different temperature and humidity conditions is approximately the same for the coated and uncoated particles.

EXAMPLE 6

This example illustrates the preparation of surface-treated composite metal oxide particles by treating $TiO_2$-coated colloidal silica with hexamethyldisilazane (HMDZ) in accordance with the invention.

The composite metal oxide particles isolated in either Example 1 or Example 2 are dispersed in deionized water. HMDZ is added directly to the rigorously stirred dispersion, and allowed to react with the colloidal composite metal oxide particles.

EXAMPLE 7

This example illustrates the preparation and evaluation of toner compositions containing surface-treated composite metal oxide particles.

Oil-in-water emulsions were prepared via sonification of oil/water mixtures and stabilized by surfactants. The oils utilized were silanol terminated polydimethylsiloxane (PDMS-OH), poly-(3,3-trifluoropropylmethylsiloxane) (PDMS-F), and polydimethylsiloxane (PDMS-Me). The surfactants utilized were neutral (Triton X100), negative (sodium salt of dodecylbenzenesulfonic acid, i.e., DBSA), and positive (Ethoquad C25). The oil-in-water emulsions contained 4 wt % surfactant based on the mass of the oil. The emulsions were added to a slurry of HMDZ treated $TiO_2$-coated colloidal silica prepared according to Example 6. The combined mixtures were sonified and then dried at 130° C. The resulting solids were jet-milled and compounded with a toner, fumed silica, and a carrier.

Samples of toner were subjected to the tribocharge measurements described in Example 5. The results are depicted in Tables 2 and 3.

TABLE 2

Tribocharge Measurements of Toner Comprising PDMS-F and PDMS-OH Oils

| Sample | Type of Oil | Type of Surfactant | HH (μC/g) | LL (μC/g) | Delta (%) |
|---|---|---|---|---|---|
| 7A | PDMS-F | neutral | −21.6 | −51.5 | 58 |
| 7B | PDMS-F | neutral | −20.6 | −45.1 | 54 |
| 7C | PDMS-F | negative | −20.5 | −49.4 | 59 |

TABLE 2-continued

Tribocharge Measurements of Toner Comprising PDMS-F and PDMS-OH Oils

| Sample | Type of Oil | Type of Surfactant | HH (μC/g) | LL (μC/g) | Delta (%) |
|---|---|---|---|---|---|
| 7D | PDMS-F | positive | −22.6 | −54.3 | 59 |
| 7E | PDMS-OH | neutral | −21.2 | −60.0 | 65 |
| 7F | PDMS-OH | negative | −18.7 | −54.8 | 66 |
| 7G | PDMS-OH | positive | −21.2 | −56.7 | 63 |

TABLE 3

Tribocharge Measurements of Toner Comprising PDMS-Me Oils

| Sample | Type of Surfactant | Viscosity of PDMS Oil (cSt) | Oil Loading | HH (μC/g) | LL (μC/g) | Delta (%) |
|---|---|---|---|---|---|---|
| 7H | neutral | 50 | 6 | −22.2 | −48.3 | 54 |
| 7I | negative | 100 | 6 | −22.0 | −49.6 | 56 |
| 7J | positive | 20 | 6 | −18.7 | −43.6 | 57 |
| 7K | neutral | 100 | 1 | −20.7 | −54.1 | 62 |
| 7L | neutral | 20 | 3 | −20.3 | −51 | 60 |
| 7M | positive | 100 | 3 | −23.7 | −52.7 | 55 |
| 7N | negative | 20 | 1 | −22.6 | −55.7 | 59 |
| 7O | positive | 50 | 1 | −21.6 | −56.3 | 62 |
| 7P | negative | 50 | 3 | −26.9 | −50.5 | 47 |

These results demonstrate that toner compositions comprising PDMS-F and PDMS-Me and surface-treated composite metal oxide particles reduce tribocharge dependence on humidity conditions. In addition, these results demonstrate that increased oil loadings of PDMS-Me lead to materials with less negative tribocharge at low temperature and low humidity ("LL") conditions and consequently with a smaller relative change of charge ("delta") at different temperature and humidity conditions.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A toner composition comprising (a) toner particles, and (b) composite metal oxide particles comprising (i) a core consisting of a first metal oxide, wherein the core is substantially spherical and non-aggregated and has a surface, and (ii) a coating consisting of a second metal oxide, wherein the coating is adhered to the surface of the core, the coating is continuous or non-continuous, and the second metal oxide is identical to or different from the first metal oxide, and wherein the first metal oxide and the second metal oxide are selected from the group consisting of silica, alumina, titania, zinc oxide, tin oxide, and cerium oxide, with the proviso that the second metal oxide is not identical to the first metal oxide if the coating is continuous, and wherein the composite metal oxide particles have a geometric standard deviation $\sigma_g$ of less than 1.5.

2. The toner composition of claim 1, wherein the composite metal oxide particles have an average particle diameter of about 5 nm to 400 nm.

3. The toner composition of claim 1, wherein the first metal oxide is different from the second metal oxide.

4. The toner composition of claim 1, wherein the composite metal oxide particles have a $\sigma_g$ of less than 1.3.

5. The toner composition of claim 1, wherein the core has a $D_{max}/D_{min}<1.4$.

6. The toner composition of claim 1, wherein the coating is between about 1 wt% and about 50 wt% of the composite metal oxide particle.

7. The toner composition of claim 1, wherein the coating is continuous.

8. The toner composition of claim 7, wherein the coating has a thickness between about 0.1 nm and about 150 nm.

9. The toner composition of claim 8, wherein the coating has a thickness between about 1 nm and about 15 nm.

10. The toner composition of claim 1, wherein the coating is non-continuous.

11. The toner composition of claim 1, wherein the coating is comprised of metal oxide particles with a geometric mean diameter between about 1 nm and about 10 nm.

12. The toner composition of claim 1, wherein the core is silica, and the coating is titania.

13. The toner composition of claim 1, wherein the core is alumina, and the coating is titania.

14. The toner composition of claim 1, wherein the core is silica, and the coating is silica.

15. The toner composition of claim 1, wherein the composite metal oxide particles are surface-treated with a silyl amine treating agent.

16. The toner composition of claim 15, wherein the silyl amine treating agent has the general formula $(R_3Si)_nNR'_{(3-n)}$ wherein n is 1-3;

each R is independently selected from the group consisting of hydrogen, a $C_1$-$C_{18}$ alkyl, a $C_3$-$C_{18}$ haloalkyl, vinyl, a $C_6$-$C_{14}$ aromatic group, a $C_2$-$C_{18}$ alkenyl group, a $C_3$-$C_{18}$ epoxylalkyl group, and $C_mH_{2m}X$, wherein m is 1-18;

each R' is independently hydrogen, $C_1$-$C_{18}$, or when n=1, a $C_2$-$C_6$ cyclic alkylene;

X is $NR''_2$, SH, OH, $OC(O)CR''=CR''_2$, $CO_2R''$, or CN; and

R'' is independently hydrogen, a $C_1$-$C_{18}$ alkyl, a $C_2$-$C_{18}$ unsaturated group, a $C_1$-$C_{18}$ acyl or $C_3$-$C_{18}$ unsaturated acyl group, a $C_2$-$C_6$ cyclic alkylene, or a $C_6$-$C_{18}$ aromatic group.

17. The toner composition of claim 16, wherein each R' is hydrogen.

18. The toner composition of claim 15, wherein the silyl amine treating agent is a bisaminodisilane.

19. The toner composition of claim 18, wherein the silyl amine treating agent is bis(dimethylaminodimethylsilyl) ethane.

20. The toner composition of claim 18, wherein the silyl amine treating agent is hexamethyldisilazane.

21. The toner composition of claim 15, wherein the silyl amine treating agent is a silazane having the formula

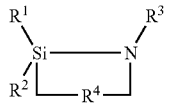

wherein $R^1$ and $R^2$ are independently selected from the group consisting of hydrogen, halogen, alkyl, alkoxy, aryl, and aryloxy;

$R^3$ is selected from the group consisting of hydrogen, $(CH_2)_nCH_3$, wherein n is an integer between 0and 3, $C(O)(CH_2)_nCH_3$, wherein n is an integer between 0 and 3, $C(O)NH_2$, $C(O)NH(CH_2)_nCH_3$, wherein n is an integer between 0 and 3, and $C(O)N[(CH_2)_nCH_3](CH_2)_mCH_3$, wherein n and m are integers between 0 and 3; and $R^4$ is $[(CH_2)_a(CHX)_b,(CYZ)_c]$, wherein X, Y, and Z are independently selected from the group consisting of hydrogen, halogen, $C_1$-$C_{10}$ alkyl, $C_1$-$C_{10}$ alkoxy, aryl, and aryloxy, and a, b, and c are integers of 0 to 6 satisfying the condition that (a+b+c) equals an integer of 2 to 6.

22. The toner composition of claim 1, wherein the composite metal oxide particles are surface-treated with a silane compound having the general formula $$(R^5)_nSiX_{4-n}$$

wherein $R^5$ is selected from the group consisting of unsubstituted or fluorine substituted aryl, arylalkyl, alkynyl, alkenyl, and alkyl, wherein X is selected from the group consisting of halogen and alkoxy, and wherein n is an integer of 1 to 3.

23. A method of preparing a toner composition comprising (a) forming composite metal oxide particles in water, wherein the composite metal oxide particles comprise (i) a core consisting of a first metal oxide, wherein the core is substantially spherical and non-aggregated and has a surface, and (ii) a coating consisting of a second metal oxide, wherein the coating is adhered to the surface of the core, the coating is continuous or non-continuous, and the second metal oxide is identical to or different from the first metal oxide, and wherein the first metal oxide and the second metal oxide are selected from the group consisting of silica, alumina, titania, zinc oxide, tin oxide, and cerium oxide, with the proviso that the second metal oxide is not identical to the first metal oxide if the coating is continuous, and wherein the composite metal oxide particles have a geometric standard deviation $\sigma_g$ of less than 1.5, by either (i) adding a metal alkoxide to an aqueous colloidal metal oxide dispersion comprising metal oxide particles or (ii) adding an aqueous colloidal metal oxide dispersion comprising particles of a first metal oxide to an acidic solution of a second metal oxide, (b) isolating the composite metal oxide particles, and (c) combining the composite metal oxide particles with toner particles to provide a toner composition.

24. The method of claim 23, which method further comprises isolating the composite metal oxide particles in step (b) without completely drying the composite metal oxide particles, and then, before step (c), preparing an aqueous colloidal dispersion comprising the composite metal oxide particles, combining the aqueous colloidal dispersion of the composite metal oxide particles with a surface treating agent to thereby form surface-treated composite metal oxide particles, and isolating and drying the surface-treated composite metal oxide particles before combining the surface-treated composite metal oxide particles with the toner particles to provide the toner composition.

25. The method of claim 23, wherein forming the composite metal oxide particles in water in step (a) is accomplished by adding a metal alkoxide to an aqueous colloidal metal oxide dispersion comprising metal oxide particles.

26. The method of claim 25, wherein the metal of the colloidal metal oxide is different from the metal of the metal alkoxide.

27. The method of claim 23, wherein foaming the composite metal oxide particles in water in step (a) is accomplished by adding an aqueous colloidal metal oxide dispersion comprising particles of a first metal oxide to an acidic solution of a second metal oxide.

28. The method of claim 27, wherein the first metal oxide is different from the second metal oxide.

* * * * *